US006834634B2

(12) United States Patent
Lawrence

(10) Patent No.: US 6,834,634 B2
(45) Date of Patent: Dec. 28, 2004

(54) CYLINDER BLOCK WITH A COMPONENT MOUNTING APRON

(75) Inventor: Howard J. Lawrence, Southampton (GB)

(73) Assignee: Perkins Engines Company Limited, Peterborough ( * ) Notice: Subject to any disclaimer, the term of this patent is extended or adjusted under 35 U.S.C. 154(b) by 44 days.

(21) Appl. No.: 10/098,026

(22) Filed: Mar. 14, 2002

(65) Prior Publication Data

US 2002/0148431 A1 Oct. 17, 2002

(30) Foreign Application Priority Data

Mar. 16, 2001 (GB) ..... 0106506

(51) Int. Cl.[7] ..... F02F 7/00
(52) U.S. Cl. ..... 123/195 C; 123/195 A
(58) Field of Search ..... 123/195 C, 195 A, 123/195 R, 195 S

(56) References Cited

U.S. PATENT DOCUMENTS

| | | | | |
|---|---|---|---|---|
| 2,303,093 A | | 11/1942 | Schreck | |
| 3,263,663 A | | 8/1966 | Connell | |
| 4,697,782 A | * | 10/1987 | Ban | 123/195 A |
| 5,063,897 A | * | 11/1991 | Okui et al. | 123/195 A |
| 5,065,713 A | | 11/1991 | Seats | |
| 5,125,376 A | * | 6/1992 | Williams et al. | 123/195 A |
| 5,203,293 A | * | 4/1993 | Shintani et al. | 123/195 A |
| 5,207,195 A | * | 5/1993 | McClintic | 123/195 A |
| 5,704,329 A | * | 1/1998 | Bublitz et al. | 123/195 A |
| 6,101,995 A | * | 8/2000 | Itoh et al. | 123/195 A |
| 6,334,421 B1 | * | 1/2002 | Singer et al. | 123/195 A |

FOREIGN PATENT DOCUMENTS

| | | |
|---|---|---|
| GB | 2038414 A | 7/1980 |
| GB | 2342391 A | 4/2000 |
| JP | 58-72620 | 4/1983 |
| WO | WO 02/04802 | 1/2002 |

* cited by examiner

*Primary Examiner*—Henry Yuen
*Assistant Examiner*—Jason Benton
(74) *Attorney, Agent, or Firm*—Finnegan, Henderson, Farabow, Garrett & Dunner; John J Cheek

(57) ABSTRACT

A cylinder block assembly for an engine comprises a cylinder block having a sidewall provided with apron attachment points and an apron mountable on the sidewall. The apron is adapted to receive engine components and comprises a tray-like cover which is dimensioned to substantially conform with the side of the cylinder block, thereby avoiding the need to machine the cylinder block to receive engine components. A cylinder block may be customized by the provision of an apron having appropriate components attached to the cylinder block, so that a single cylinder block can be used for a number of different engines.

18 Claims, 4 Drawing Sheets

CYLINDER BLOCK WITH A COMPONENT MOUNTING APRON

TECHNICAL FIELD

This invention relates to a cylinder block assembly to which engine components may be mounted and to an internal combustion engine including the cylinder block assembly. The invention also relates to a method for fabricating an engine and mounting engine components thereto.

BACKGROUND

Cylinder blocks are in general extremely expensive to fabricate. In particular, where a cylinder block must be customized for particular applications e.g. to receive engine accessories, costs increase greatly. Moreover, the degree to which cylinder blocks can be customized is in general limited.

Known cylinder blocks are not easily configurable externally to suit different vehicle or static installations during high or low volume production which can compromise optimum manufacturing flexibility. However, in engines which are of generally similar construction but are to be installed in differing installations, for example, road vehicles or static installations such as generating sets, the cylinder blocks may require specific external configurations to accommodate engine mounting points and transmission housings dedicated to the intended installation. The aforementioned problem may be particularly acute where the cylinder block is manufactured in volumes of less than 50,000 per annum.

Where customization is possible, it is in general necessary to machine the cylinder block on at least one of a side, front or rear wall, thereby giving rise to significant additional costs.

UK Patent specification No 2342391 describes an engine having a rear end flange having apertures for mounting ancillary units. Adapter plates are provided to facilitate customization of the engine, each plate being machined to co-operate with a given aperture and dimensioned to facilitate mounting of a given size of ancillary unit. Use of the adapter plate obviates the need to machine the flange. Further, different adapted plates may be used to fit and mount different size pumps on the same aperture. As both faces of each adapter plate are machined or dimensioned for a specific task, the flexibility of use if a given plate is extremely limited. Moreover, each plate is designed to mount only a single ancillary unit. The present invention sets out to overcome one or more of the disadvantages of the prior art.

SUMMARY OF THE INVENTION

In accordance with one aspect of this invention, a cylinder block assembly for an engine comprises a cylinder block having a sidewall provided with apron attachment points, and an apron mountable on said sidewall. The apron is adapted to receive engine components, and the apron comprises a tray-like cover.

According to another aspect of this invention, an apron for mounting to a sidewall of a cylinder block of an engine comprises a tray-like cover adapted to receive engine components, In accordance with another aspect of this invention, a cylinder block assembly for an engine comprises a cylinder block having a sidewall provided with apron attachment points, and an apron mountable on the sidewall. The apron is adapted to receive engine components, and the apron being dimensioned to substantially conform with the sidewall of the cylinder block.

According to yet another aspect of this invention, a method of fabricating a plurality of customized engines is provided, each of the customized engines having a different arrangement of engine components. The method comprises the steps of (a) selecting a common cylinder block for the customized engines, the cylinder block having apron attachment points on a sidewall thereof; (b) selecting a customized apron corresponding to the customized engine to be fabricated; (c) attaching the customized apron to the sidewall of the cylinder block; and (d) mounting at least one engine component corresponding to the customized engine to be fabricated on the customized apron

BRIEF DESCRIPTION OF THE DRAWINGS

Various embodiments of the invention will now be described, by way of example only, having regard to the accompanying diagrammatic drawings in which.

DETAILED DESCRIPTION

Figure 1:
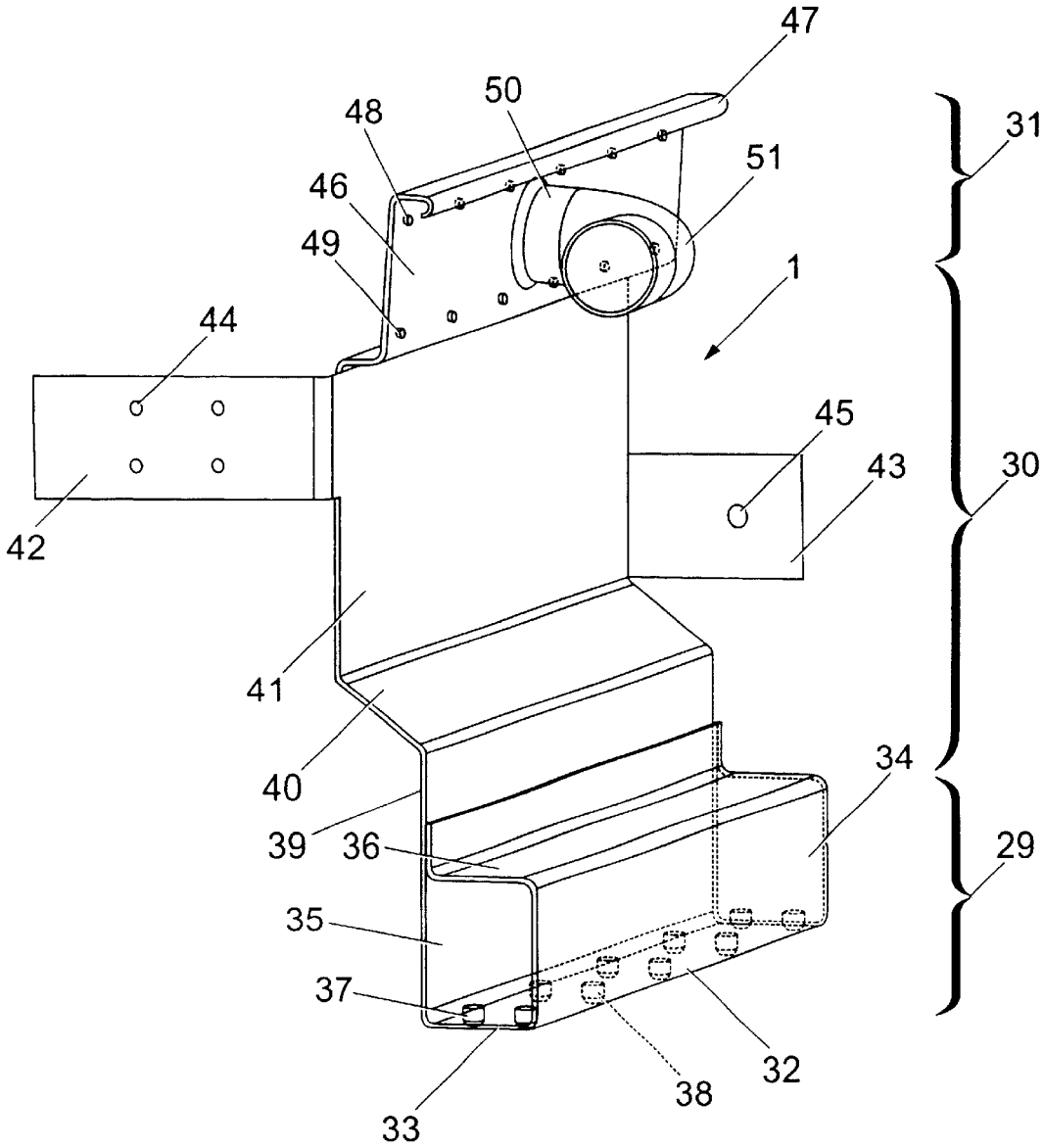
FIG. 1 is an isometric view of a cylinder block apron in accordance with the invention.

As shown in the drawings, a cylinder block apron 1 in accordance with the invention is a generally tray-like cover mountable on and co-operable with a cylinder block 2 which is adapted to receive the apron 1 in a mating relationship. The apron 1 is dimensioned to substantially conform with a sidewall 6,7 of the cylinder block 2. The apron 1 facilitates configurational flexibility of the cylinder block 2 to provide a low cost attachment method for engine subsystem components without requiring machining of a sidewall 6 of the cylinder block 2.

Figure 2:
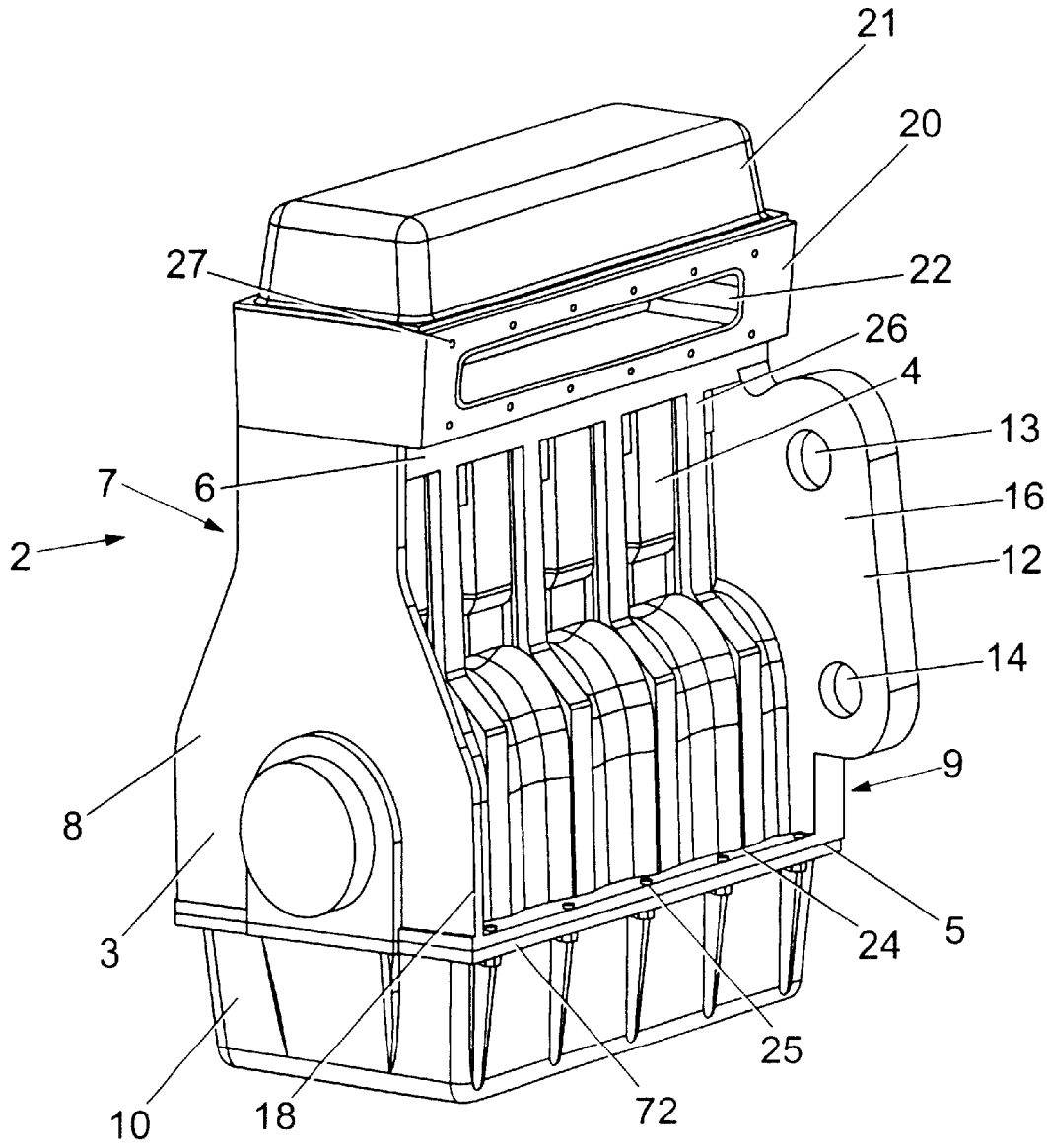
FIG. 2 is an isometric view of an engine including a cylinder block adapted to receive the apron of FIG. 1.

As shown in FIG. 2, in the present embodiment of the invention, the cylinder block 2 is a substantially conventional cylinder block 2. However, the apron 1 may be adapted for use with various cylinder block types without departing from the scope of the invention.

The cylinder block 2 is made up of a cylinder block core 3, a cylinder block outer body 4 and a cylinder block base 5. The cylinder block 2 includes a cylinder block first side wall 6, a cylinder block second side wall 7 substantially parallel with the cylinder block first side wall 6, a cylinder block front end wall 8 and a cylinder block rear end wall 9 all upstanding from the cylinder block base 5. In the present example, the first side wall 6 is substantially non-machined, i.e. free of tapped bosses, machined faces, extended structures and other features normally required to secure ancillary engine components to the cylinder block 2.

A sump 10 is attached to the cylinder block base 5. Optionally, the sump 10 is of a composite construction and may be provided with a sump guard 11 customized for attachment to the apron 1. The sump guard provides a base for the engine during engine storage and transport, thus precluding damage that could be inflicted upon a sump made from a composite or other lightweight material. The sump guard 11 is made up of a metal sheet or other suitable material and is configured to have an open-ended U-shape, though the sump guard may, if required, be provided with end walls. The sump guard 11 therefore has a bottom wall 68, a first side wall 69 and a second sidewall 70 upstanding from the bottom wall 68. The first side wall 69 and the second side wall 70 are provided with sump guard rails 54*a,b* at their free ends for securing the sump guard 11 to the apron 1 at side wall 6 and to a second apron 1 or other attachment such as a bracket (not shown) at side wall 7.

Figure 3:
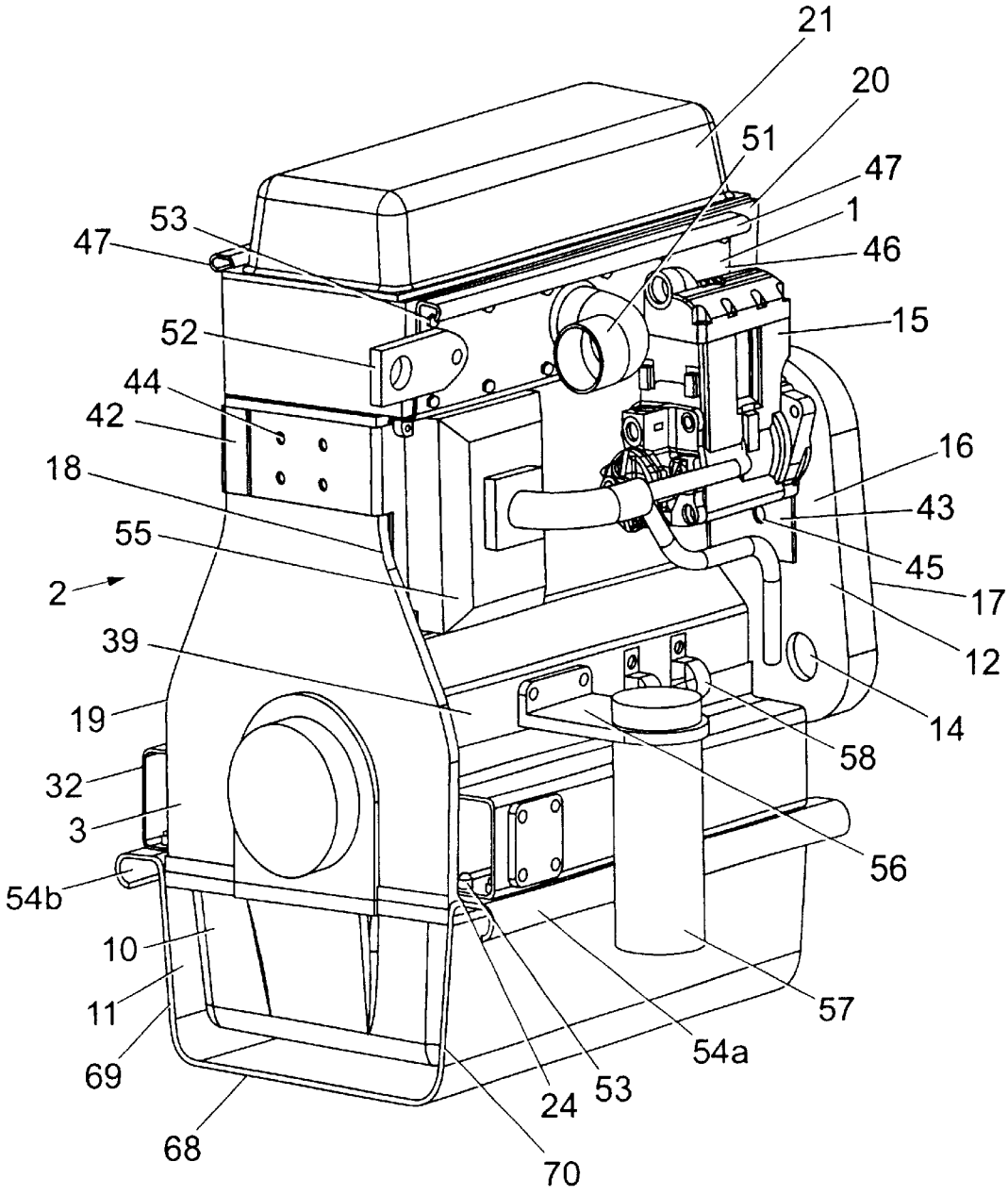
FIG. 3 is an isometric view of the apron of FIG. 1 mounted on the cylinder block of FIG. 2 with an optional sump guard attached to the apron.

The cylinder block rear end wall 9 is provided with a bearing plate 12 which projects laterally outwards from the first side wall 6. The bearing plate 12 has an inner face 16 disposed towards the sidewall 6. The bearing plate 12 is provided with an upper bore 13 and a lower bore 14 to receive engine ancillary components. For example, as shown in FIG. 3, a fuel pump 15 is mounted in the upper bore 13 on the inner face 16.

The front end wall 8 projects laterally outwardly from the first side walls 6 to define a flange 18.

The cylinder block 2 is provided with a cylinder head 20 fitted with a cylinder head cover 21. The cylinder head 20 is provided with an integral air inlet manifold 22.

The cylinder block 2 and the cylinder head 20 are provided with attachment points 25, 26, 27 for facilitating attachment of the structural apron 1 to the cylinder block 2 and the cylinder head 20. In a preferred embodiment, the attachment points are made up of a combination of mechanical (25, 27) and adhesive (26) attachment points. However, any structurally sound construction for attaching the apron 1 to the cylinder block 2 and cylinder head 20 is suitable and within the scope of the invention. For example, the attachment points may be exclusively mechanical or exclusively adhesive, or combined with other suitable forms of attachment point.

The cylinder block 2 has a bottom flange 24 at the cylinder block base 5 along the first side wall 6. Flange 24 is provided with flange holes 25 for receiving fasteners to mechanically secure the apron 1 to the cylinder block 2.

The cylinder block 2 is also provided with adhesive receiving ribs 26 formed on the first side walls 6 of the cylinder block 2 for receiving adhesive to adhesively secure the apron 1 to the cylinder block 2. The ribs 26 extend vertically upwards from the cylinder block base 5.

Preferably, the cylinder head 20 has threaded holes 27 surrounding the inlet manifold 22. The threaded holes 27 are adapted to receive fasteners to mechanically secure the apron 1 to the cylinder head 20.

As indicated above, the apron 1 is substantially tray-like in shape. The apron 1 is formed from a sheet metal or other suitable material shaped or configured so that the apron 1 is adapted to mate with the sidewall 6 of cylinder block 2. The apron 1 is dimensioned to substantially conform with the dimensions of the cylinder block 2. However, it is intended that the apron of the invention may in certain instances be dimensioned to cover an externally mounted balance shaft. For example, the apron 1 is dimensioned to fit between the bearing plate 12 and the flange 18 and between the cylinder block base 5 and cylinder head 20 at the sidewall 6. As shown particularly in FIG. 1, the apron 1 is made up of a bottom portion 29, a central cylinder block portion 30 and a top cylinder head portion 31.

The bottom portion 29 of the apron 1 is folded to define an elongate beam 32 having a box-like cross section. The box-like elongate beam 32 is therefore made up of a beam bottom wall 33 having elongate first and second beam side walls 34, 35 respectively upstanding therefrom. The box-like beam 32 is further provided with a beam top wall 36 extending between the first and second side walls 34, 35 respectively.

The beam bottom wall 33 is provided with a first and second series of spaced apart beam attachment holes 37, 38 respectively. The first series of attachment holes 37 is located on the beam bottom wall 33 to complement the flange holes 25 on the cylinder block 2. The second series of attachment holes 38 is adapted to receive sump guard fasteners to secure the optional sump guard 11 to the apron 1.

The elongate beam 32 provides additional and efficient stiffness to an assembled engine structure while the box-like construction of the beam 32 serves as a chassis rail and provides stiffened engine mounting locations. The elongate beam 32 is hollow and open at at least one end, so that the tines (not shown) of a fork lift truck or other lifting apparatus may be inserted in the beams 32 provided on each side of the engine structure to facilitate lifting of the engine structure.

The central cylinder block portion 30 is contiguous with the tray bottom portion 29 and is shaped and folded to facilitate mating of the apron 1 with the cylinder block first sidewall 6.

The central cylinder block portion 30 of the apron 1 is made up of an upstanding panel 39 which is a continuation of the second beam side wall 35, a transverse panel 40 and a upstanding primary panel 41 adapted to abut the ribs 26 on the cylinder block 2. The upstanding panel 39, the transverse panel 40 and the primary panel 41 are separated by fold lines about which the apron 1 is folded as previously described.

The primary panel 41 is provided with a front mounting panel 42 which extends inwardly from the primary panel 41 in a plane disposed perpendicular to a plane defined by the primary panel 41 and oriented to mate with the front end wall 8 of the cylinder block 2. Front mounting panel 42 is provided with front mounting panel through holes 44 adapted to receive fasteners for securing the front mounting panel 42, and hence the apron 1, to the cylinder block 2. The rear mounting panel 43 extends outwardly from the primary panel 41 in a plane disposed perpendicular to the plane of the primary panel 41 and in an orthogonal direction away from side wall 6. The rear mounting panel 43 is also provided with a through hole 45 for receiving a fastener for securing the rear mounting panel 43 to the bearing plate inner face 16.

In an alternative embodiment, the front mounting panel 42 and the rear mounting panel 43 can be extended in length if required to join or meet with an apron 1 located on an opposite side wall 7 of the cylinder block 2 to provide additional attachment areas for engine auxiliary components, e.g. fan mountings and the like.

The apron cylinder head portion 31 is made up of an upright cylinder head panel 46 contiguous with the primary panel 41. The cylinder head panel 46, like the primary panel 41, is disposed in a substantially upright disposition and is shaped at its free end to define an elongate top rail 47. The top rail 47 projects outwardly away from the cylinder head 20.

The top rail 47 provides additional stiffness to an assembled engine structure while in an alternative embodiment also serving to attach the apron 1 to the cylinder head 20 where the apron 1 and the cylinder head 20 are provided with suitable attachment points. In a still further embodiment the top rail 47 can also be adapted to be fastened to the cylinder head cover 21 if required.

The cylinder head panel 46 has a top series of spaced apart mounting holes 48 located adjacent the top rail 47 and a bottom series of spaced apart mounting holes 49. The top series of mounting holes 48 and the bottom series of mounting holes 49 are adapted to receive fasteners for securing the cylinder head panel 46 to the cylinder head 20.

The cylinder head panel 46 has an aperture 50 to facilitate communication between an elbow connector 51 engageable with the aperture 50 and the air inlet manifold 22 within the cylinder head 20.

FIG. 3 shows the cylinder block 2 fitted with the apron 1 of FIG. 1. FIG. 3 shows the cylinder head panel 46 further provided with a lifting eye 52 to facilitate lifting of a cylinder block 2 to which the apron 1 is attached. The apron 1 is mounted on the cylinder block first side wall 6. However, it will be appreciated that an apron 1 can be mounted on any one or more of the first side wall 6 and the second side wall 7.

The apron 1 is fastened to the side wall 6 by fasteners 53 inserted through holes (not shown) in flange 72 of the sump 10, through corresponding holes 25 in the flange 24 of the cylinder block 2 and into threaded holes 37 in the beam bottom wall 33.

The cylinder head panel 46 of the apron 1 is secured to the cylinder head 20 by fasteners 73 inserted through the mounting holes 48, 49 of the cylinder head panel 46 into the corresponding threaded holes 27 in the cylinder head 20.

As previously described, the ribs 26 on the cylinder block 2 can also be secured to the primary panel 41 of the apron 1 by an adhesive such as a flexible non-setting adhesive which could be applied by a robot applicator or screen printing of the adhesive on to the apron 1. A non-setting adhesive facilitates creep of the apron 1 on the cylinder block 2 while also serving to damp engine vibrations.

The optional sump guard 11 is secured to the apron 1 by inserting fasteners 53 through holes in the sump guard rail 54 into corresponding threaded holes 38 on the beam bottom wall 33.

The fasteners 53 can be any suitable fasteners such as threaded screws or studs and nuts. Threaded holes 37, 38 can be formed by any conventional means such as weld nuts, rivet nuts, edge clips and the like. Alternatively, threaded holes 37, 38 can be formed by the "Flowform" (Trade Mark) process in which a hole is pierced in apron 1 and thread-rolled. Alternatively, the fasteners 53 may be weld studs, self-tapping screws, rivets or the like, in which case the holes 37, 38 will not need to be pre-threaded.

Attachment of the sump guard 11 to the apron 1 increases the stiffness of an assembled engine structure. Accordingly, due to the increased stiffness, traditional stressed cast iron sumps used in frameless tractor applications can be dispensed with while a lighter weight construction for the sump (e.g. plastics moldings) can be employed due to the increased stiffness provided by the apron to the sump guard.

The apron 1 is secured to the front end wall 8 of the cylinder block 2 at the front mounting panel 42 by fasteners and to the bearing plate inner face 16 at the rear mounting panel 43 by fasteners.

Engine mountings and engine component mountings can be formed and located on the apron 1 as required in accordance with a desired installation by welding suitable mountings to the apron. For example the apron 1 can be provided with an array of individual tapped cylindrical bosses (not shown) welded to the elongate beam 32, separate formed brackets (not shown) designed to suit installation mounting locations and welded to the apron 1 at distributed and reinforced locations and/or one or more thickened plates 71, each with an array of tapped holes, welded to the elongate beam 32 (see FIG. 4).

Ancillary engine components and accessories can therefore be mounted to the apron 1 instead of the cylinder block 2 thereby obviating machining of at least one wall (side wall 6 in the present example). For example, as shown in FIG. 3, an electronic control unit (ECU) 55 is mounted on the primary panel 41. The apron 1 is adapted to receive engine components by any suitable fastening means.

The upstanding panel 39 of the central cylinder block portion 30 of the apron 1 has an oil filter mounting bracket 56 for supporting an oil filter 57. The upstanding panel 39 is also provided with cable clips 58 for supporting cables on the apron 1.

An elbow connector 51 is also connected to the cylinder head panel 46 for facilitating communication to the air inlet manifold 22. In an alternative embodiment of the invention extended and low strength manifolds, such as plastics manifolds used in automobiles, can be supported by the apron 1.

As previously described, the fuel pump 15 is mounted in the upper bore 13 on the inner face 16. The fuel pump 15 is not mounted directly on the apron 1 but is nevertheless supported by the apron 1 at a bracket (not shown).

Figure 4:
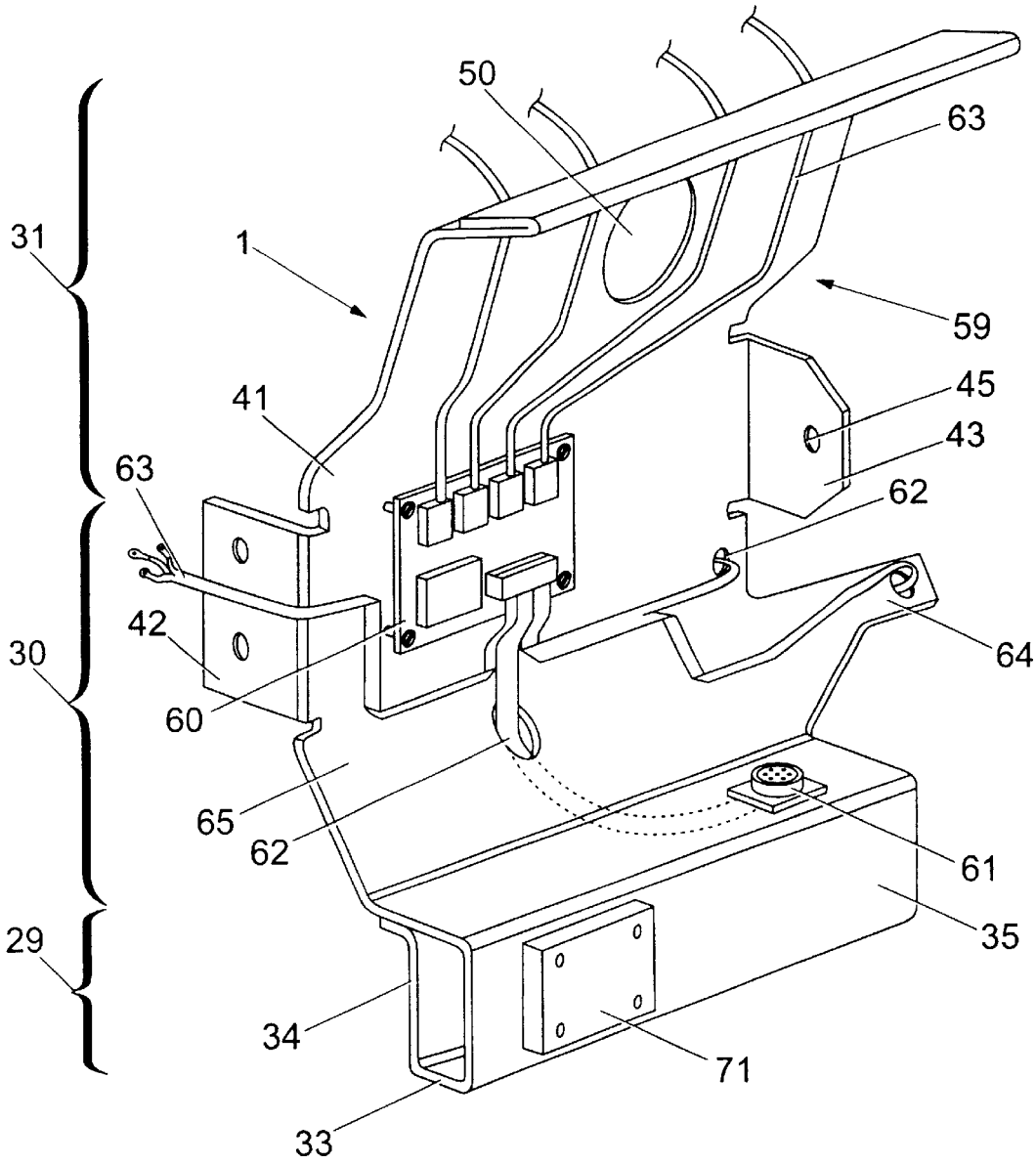
FIG. 4 is an isometric view of a further embodiment of the apron of the invention in which the apron is provided with electrical harness elements and an electronic control unit.

FIG. 4 shows an isometric view of a second embodiment of an apron 1 of the invention. The apron of FIG. 4 is broadly similar to the apron described in FIG. 1 above. Accordingly, like numerals indicate like parts. However, in the present embodiment, the apron 1 is adapted to support electrical harness elements 59 on an external face 65 of the sheet metal material of the apron 1. The apron 1 therefore serves as an extended circuit board for the electrical harness elements 59.

The electrical harness elements 59 are made up of an electronic circuit board 60 mounted on the face 65 of the apron 1 and ribbon cables 63 extending from the electronic circuit board 60 to various engine parts (not shown). The electrical harness elements 59 are also made up of a machine interface connector 61 also mounted on the face 65 of the apron 1.

The face 65 may be an internal face, in which case the apron 1 serves to protect the electrical harness elements 59 located between the apron 1 and the cylinder block 2 when the apron 1 is mounted on the cylinder block 2.

The apron 1 is further provided with ribbon cable openings 62 in the apron 1 to facilitate communication of the ribbon cables 63 between the electronic circuit board 60 and the engine components.

In the present embodiment of the invention, the apron 1 is provided with a third mounting panel 64 for securing the apron 1 to the cylinder block 2 in accordance with the shape of the cylinder block 2 for which the apron 1 of FIG. 4 is configured.

As indicated above the apron 1 of the invention can be employed with a cylinder block 2 having a conventional cylinder head 20.

However, in an alternative embodiment of the invention, it is envisaged that the cylinder head 20 can be made up of a cylinder head 20 having side walls terminating at a top peripheral flange attachable to a cylinder head cover 21. In a still further embodiment of the invention, the face of the cylinder head 20 on which the inlet manifold 22 is located, together with the cylinder head panel 46 of the apron 1, can be angled outwards to facilitate vertical removal of the cylinder head 2 without disturbing the apron 1. Accordingly, following removal of the fasteners 53 from the cylinder head panel 46 of the apron 1, the cylinder head 20 can be easily removed from the apron 1 to facilitate lifting of the cylinder head 20 from the cylinder block 2.

In the given example, apron 1 is envisaged as having a thickness of from about 2 to about 4 millimeters but thickness selection will need to take into account variables such as the required stiffness, ease of forming and the duty to which the apron is to be subjected to, as well as the accessories to be mounted thereon and whether engine mountings and transmission housings are to be attached thereto. The apron 1 may be reinforced locally as required. The apron can be flat folded and bent or pressed to shape as required.

The apron 1 is preferably formed from high strength low alloy (HSLA) steel but can also be formed from cold rolled mild steel, aluminum sheet or any other material having suitable characteristics. The apron 1 can be configured by laser machining or the like or may be numerically controlled punch profiled. The apron 1 may be folded by a brake press and deep drawn for pressed features.

Typically, the apron 1 is fabricated as a single formed sheet. Alternatively, the apron can be formed by welding or otherwise joining one or more panel parts to form a single integral apron. Further, the apron or its constituent parts may be configured as tailored blanks comprising panel parts of different thickness or different metallurgy. For example, the central portion 30 and top portion 31 could be formed from a mild steel for carrying light accessories whilst the bottom portion 29 could be formed from an alloy steel for carrying engine or transmission mounting points.

The apron 1 can also serve to provide an alternative to a separate cover plate for an oil cooler element where such element is fully or partly recessed within the side wall 6 of the cylinder block 2. In this embodiment of the invention, the apron 1 could be reinforced e.g. by welding an additional flange to match a profile of the cooler opening to achieve an adequate seal/joint to meet cooling jacket temperatures/pressures.

In a further embodiment of the invention, the apron 1 can provide additional outer cover and/or attachment means for an externally mounted balance shaft thus providing a noise barrier to noise emanating from the balance shaft.

The apron 1 preferably, and in general, extends over the whole of an engine side, including the cylinder head 20 and the cylinder block 2. Accordingly, the apron 1 may be provided with a color scheme as required thereby dispensing with or reducing the requirement to paint engine cylinder blocks and the like following manufacture. An advantage of employing a color is that the paint finish quality may be easily controlled e.g. with epoxy paints. Moreover, pre-painted aprons can also be employed with cylinder blocks 2 while aprons 1 formed from sheet steel can be readily plated for show or special finishes e.g. infra-red absorption, zinc, chromium, gold and the like. Moreover, anodized aluminum finishes can also be employed.

The apron 1 also serves to provide a surface for printing corporate identification, end user identification and other user instructions on an engine employing screen-printing techniques and the like. Alternatively, the apron 1 serves to provide a good bonding surface for application of adhesive labels and the like to an engine.

INDUSTRIAL APPLICABILITY

The apron 1 of the invention results in lower manufacturing costs for cylinder blocks 2 and in particular for cylinder blocks 2 requiring customization as side wall machining of the cylinder blocks 2 to receive engine auxiliary components is reduced or eliminated. Moreover, the apron 1 of the invention results in lower noise and vibration in engines fitted with the apron 1. The apron 1 therefore facilitates enhanced flexibility in cylinder block design and manufacture.

Examples of such engine accessories and auxiliary components include, but are not limited to: engine electronic control units and wiring harnesses, clips and ties; low pressure fuel system components such as lift pumps, filters, pipes; high pressure fuel systems including fuel injection pump support brackets; lubrication system components including remote filter mountings, electric oil pumps, hose attachments and closed circuit breather system components; cooling system components including electrical cooling pumps, mechanical cooling pumps, hose attachments, heat exchangers for oil and EGR systems and fan mountings; ancillary drives including brackets and attachments for alternators, PAS pumps, vacuum pumps, compressors, air conditioning pumps, idler pulleys, tensioners and other driven accessories; air system components including air ducts and trunking, inlet manifolds and elbows, inlet air heat exchangers, exhaust mountings, TC oil drain supports and the like; emissions system components including mountings for closed coupled after-treatment devices and EGR components; engine mounting parts; transmission mounting parts.

The apron 1 can be employed with substantially conventional cylinder blocks 2 having at least one sidewall 6, 7 provided with suitable attachment points for the apron 1.

The apron 1 facilitates the reduction or elimination of tapped bosses and machined faces on at least one sidewall of the cylinder block 2. The cylinder block 2 can therefore be designed for minimal machining operations while extended structures normally needed to attach engine auxiliary components can also be dispensed with. The apron 1 can be employed with short block, deep skirt or ladder constructions of cylinder block while the cylinder block can be formed, in conventional manner, from cast iron or aluminum. The apron 1 can also facilitate engine transport and handling. For example, the elongate beam 32 may be adapted for engagement with forklift truck tines while the lifting eye 52, where present, can facilitate lifting of an engine.

As indicated above, the apron 1 can be attached to the cylinder block 2 employing low cost sheet metal fastening methods such as the Flowform (Trade Mark) process, weld nuts and studs, rivet nuts, self-tapping screws, rivets, edge clips and the like. The same fastening methods may be used to mount engine components and accessories on the apron 1.

In an alternative embodiment of the invention, the apron 1 can be provided with tapped metal strips for arrays of fasteners e.g. for attachment of the sump guard rail 54.

The apron 1 can be pre-assembled with some engine auxiliary components in order to further increase engine manufacture efficiency. Such components include electronic control units, harnesses, pipes, brackets etc., which can be pre-assembled with the apron 1 as a sub-assembly on a side feeder to a main assembly line. It will be appreciated by those skilled in the art that shorter main assembly lines serve to reduce work in progress and provide greater flexibility and reduced costs.

The apron 1 mounted on a cylinder block 2 with fasteners 53 and adhesive facilitates damping and lessens acoustic energy at an engine surface to reduce radiated noise.

Moreover, the apron 1 provides additional structural stiffness to increase natural bending/torsion frequencies and thereby reduce transmitted noise and vibration to permit optimal mounting designs.

The apron 1 provides application design flexibility and facilitates customization of an engine. For example, aprons 1 manufactured on adaptable numerically controlled laser profilers, punches and brake presses may be easily customized to customize the cylinder block 2. Such equipment could be located close to an assembly line to provide late specification flexible manufacture of cylinder blocks while the ease with which additional brackets and other fabricated parts may be welded or otherwise joined to the apron 1 provides a means for satisfying customer specific requirements without excessive tooling costs or disruption to base engine production. In effect, engine mountings and other apparatus may be located at a desired location on the apron 1 as required without significant additional costs. A common cylinder block 2 can thus be used with a number of customized aprons 1 to manufacture a number of customized engines, each different customized engine having a different arrangement of engine components mounted on the corresponding customized apron 1.

The invention is not limited to the embodiments herein described which can be varied in construction and detail.

What is claimed is:

1. A cylinder block assembly for an engine comprising:

a cylinder block having a sidewall provided with apron attachment points, said cylinder block including an array of cylinders arranged in a direction alone a length of the cylinder block; and an apron mountable on the sidewall, said apron extending substantially in the direction of said array of cylinders and being adapted to receive engine components, said apron comprising a tray-like cover.

2. A cylinder block assembly as set forth in claim 1 wherein the apron is dimensioned to substantially conform with the sidewall of the cylinder block.

3. A cylinder block assembly as set forth in claim 1 wherein the sidewall is substantially non-machined.

4. A cylinder block assembly as set forth in claim 1 wherein the attachment points include adhesive attachment points.

5. A cylinder block assembly for an engine comprising:

a cylinder block having a sidewall provided with apron attachment points; and an apron mountable on the sidewall, said apron being adapted to receive engine components, said apron comprising a tray-like cover, wherein the attachment points are adhesive attachment points including adhesive receiving ribs formed on the cylinder block.

6. A cylinder block assembly as set forth in claim 1 wherein the apron includes an elongate beam adapted for engagement with a tine of a lifting apparatus.

7. A cylinder block assembly as set forth in claim 1 further including at least one engine component mounted on the apron.

8. A cylinder block assembly as set forth in claim 7, wherein said at least one engine component is selected from the group consisting of:

engine electronic control units and wiring harnesses, clips and ties; low pressure fuel system components such as lift pumps, filters, pipes; high pressure fuel systems including fuel injection pump support brackets; lubrication system components including remote filter mountings, electric oil pumps, hose attachments and closed circuit breather system components; cooling system components including electrical cooling pumps, mechanical cooling pumps, hose attachments, heat exchangers for oil and EGR systems and fan mountings; ancillary drives including brackets and attachments for alternators, PAS pumps, vacuum pumps, compressors, air conditioning pumps, idler pulleys, tensioners and other driven accessories; air system components including air ducts and trunking, inlet manifolds and elbows, inlet air heat exchangers, exhaust mountings, TC oil drain supports and the like; emissions system components including mountings for closed coupled after-treatment devices and EGR components; engine mounting parts; transmission mounting parts.

9. An engine, comprising:

a cylinder block assembly as set forth in claim 1;

a cylinder head mounted to said cylinder block; and at least one engine component mounted to the apron forming part of said cylinder block assembly.

10. A method of fabricating an engine including a cylinder block comprising the steps of:

providing apron attachment points on a sidewall of the cylinder block, said cylinder block including an array of cylinders arranged in a direction along a length of the cylinder block;

selecting and attaching an apron to the sidewall of the cylinder block, said apron extending substantially in the direction of said array of cylinders and comprising a tray-like cover; and mounting at least one engine component on the apron.

11. A method of fabricating a plurality of customized engines, each of said customized engines having a different arrangement of engine components, comprising the steps of:

selecting a common cylinder block for said customized engines, said cylinder block having apron attachment points on a sidewall thereof;

selecting, from a plurality of customized aprons, a customized apron corresponding to the customized engine to be fabricated;

attaching said customized apron to the sidewall of the cylinder block; and mounting at least one engine component corresponding to the customized engine to be fabricated on said customized apron.

12. A method as set forth in claim 11 wherein the customized apron comprises a tray-like cover.

13. A method as set forth in claim 11 wherein the customized apron is dimensioned to substantially conform with the side of the cylinder block.

14. A method as set forth in claim 12 wherein the customized apron is dimensioned to substantially conform with the side of the cylinder block.

15. A method as set forth in claim 11 wherein a plurality of engine components are mounted on the customized apron, the engine components being selected from the group consisting of:

engine electronic control units and wiring harnesses, clips and ties; low pressure fuel system components such as lift pumps, filters, pipes; high pressure fuel systems including fuel injection pump support brackets; lubrication system components including remote filter mountings, electric oil pumps, hose attachments and closed circuit breather system components; cooling system components including electrical cooling pumps, mechanical cooling pumps, hose attachments, heat exchangers for oil and EGR systems and fan mountings; ancillary drives including brackets and attachments for alternators, PAS pumps, vacuum pumps, compressors, air conditioning pumps, idler pulleys, tensioners and other driven accessories; air system components including air ducts and trunking, inlet manifolds and elbows, inlet air heat exchangers, exhaust mountings, TC oil drain supports and the like; emissions system components including mountings for closed coupled after-treatment devices and EGR components; engine mounting parts; transmission mounting parts.

16. An apron for mounting to a sidewall of a cylinder block of an engine, said cylinder block including an array of cylinders arranged in a direction along a length of the cylinder block, the apron comprising a tray-like cover mountable on the sidewall substantially in the direction of said array of cylinders, wherein the apron is adapted to receive engine components.

17. An apron as set forth in claim 16 wherein said apron which is dimensioned to substantially conform with the sidewall of a cylinder block to which it is to be mounted.

18. A cylinder block assembly for an engine comprising:

a cylinder block having a sidewall provided with apron attachment points, said cylinder block including an array of cylinders arranged in a direction along a length of the cylinder block; and an apron mountable on the sidewall, the apron being adapted to receive engine components at various positions along said length of the cylinder block, said apron being dimensioned to substantially conform with the sidewall of the cylinder block.

* * * * *